US010431960B2

(12) United States Patent
Ohno et al.

(10) Patent No.: US 10,431,960 B2
(45) Date of Patent: Oct. 1, 2019

(54) SPARK PLUG FOR INTERNAL COMBUSTION ENGINE

(71) Applicant: DENSO CORPORATION, Kariya, Aichi-pref. (JP)

(72) Inventors: Ryuichi Ohno, Kariya (JP); Ryohei Akiyoshi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/088,976

(22) PCT Filed: Mar. 24, 2017

(86) PCT No.: PCT/JP2017/012163
§ 371 (c)(1),
(2) Date: Sep. 27, 2018

(87) PCT Pub. No.: WO2017/170276
PCT Pub. Date: Oct. 5, 2017

(65) Prior Publication Data

US 2019/0214792 A1 Jul. 11, 2019

(30) Foreign Application Priority Data

Mar. 30, 2016 (JP) ..... 2016-069347

(51) Int. Cl.
*H01T 13/22* (2006.01)
*H01T 13/32* (2006.01)

(52) U.S. Cl.
CPC ..... *H01T 13/32* (2013.01)

(58) Field of Classification Search
None
See application file for complete search history.

(56) References Cited

U.S. PATENT DOCUMENTS

2002/0067111 A1 6/2002 Shibata et al.

FOREIGN PATENT DOCUMENTS

JP 9-148045 6/1997

*Primary Examiner* — Vip Patel
(74) *Attorney, Agent, or Firm* — Nixon & Vanderhye P.C.

(57) ABSTRACT

A spark plug for an internal combustion engine includes a cylindrical housing, a cylindrical insulator, a center electrode, and a ground electrode. The ground electrode includes an upright part and an inclined part. The upright part is a portion vertically provided on a tip end part of the housing to a tip end side. The inclined part is a portion that is bent from the tip of the upright part toward the center electrode side, and is extended toward an oblique tip end side. The inclined part has a ground end face, an opposed face, and a corner curved face. The corner curved face is a face that smoothly connects the ground end face and the opposed face. The corner curved face has a curved shape. The curvature radius R of the corner curved face satisfies 0.3 mm≤R≤0.7 mm. The inclination angle θ of the inclined part with respect to a plug axial direction (Z) satisfies 30°≤θ≤60°.

4 Claims, 6 Drawing Sheets

SPARK PLUG FOR INTERNAL COMBUSTION ENGINE

CROSS-REFERENCE TO RELATED APPLICATION

This application is the U.S. national phase of International Application No. PCT/2017/1012163 filed on Mar. 24, 2017 which designated the U.S. and claims priority to Japanese Patent Application No. 2016-069347 filed on Mar. 30, 2016, the entire contents of each of which are incorporated herein by reference.

TECHNICAL FIELD

The present disclosure relates to a spark plug for an internal combustion engine.

BACKGROUND ART

As a spark plug used as ignition means in an internal combustion engine, such as an engine of an automobile, there is a spark plug in which a center electrode and a ground electrode are made to axially face each other to form a spark discharge gap. Such a spark plug generates discharge at the spark discharge gap and ignites an air-fuel mixture in a combustion chamber by the discharge.

In the combustion chamber, airflow of the air-fuel mixture, for example, such as swirl flow or tumble flow, is formed and the airflow moderately flows also at the spark discharge gap to thereby ensure ignitability.

However, depending on a mounting posture of the spark plug to the internal combustion engine, part of the ground electrode joined to a tip end part of a housing may be arranged on an upstream side of the spark discharge gap in the airflow. In this case, the airflow in the combustion chamber is blocked by the ground electrode, and the airflow near the spark discharge gap may stagnate. As a result, the ignitability of the spark plug may degrade. That is, the ignitability of the spark plug may vary depending on the mounting posture to the internal combustion engine. Particularly in recent years, lean combustion internal combustion engines are used widely. However, in such an internal combustion engine, depending on the mounting posture of the spark plug, combustion stability may be degraded.

Unless special measures are taken, it is difficult to control the mounting posture of the spark plug to the internal combustion engine, that is, the position of the ground electrode in a circumferential direction. This is because the mounting posture varies due to the formation state of a mounting screw in the housing or the tightening degree of the spark plug at the time of mounting to the internal combustion engine. Special measures may be considered such that limiting the relation between the mounting screw and the joining position of the ground electrode in the circumferential direction of the spark plug to a specific positional relation, and also limiting the orientation of a female screw on an engine head side to a predetermined direction in the circumferential direction. However, in this case, manufacturing man-hours and manufacturing cost of the spark plug and the engine head may be increased.

Thus, to suppress blocking of airflow by the ground electrode, a configuration in which drilling processing is performed in the ground electrode, and a configuration in which the ground electrode is joined to the housing by a plurality of thin plate members are disclosed (PTL 1).

CITATION LIST

Patent Literature

[PTL 1] JP H9-148045 A

SUMMARY OF THE INVENTION

The configuration in which drilling processing is performed in the ground electrode, described in Patent Literature 1, may cause reduction in strength of the ground electrode. If the ground electrode is formed thick to prevent the reduction in strength, the airflow of the air-fuel mixture is eventually easily blocked.

The configuration in which the ground electrode is joined to the housing by a plurality of thin plate members, also described in Patent Literature 1, has problems of making the shape of the ground electrode complicated, increasing the manufacturing man-hours, and increasing the manufacturing cost.

The present disclosure provides a spark plug for an internal combustion engine having a simple configuration, which can ensure stable ignitability regardless of the mounting posture with respect to the internal combustion engine.

One aspect of the present disclosure includes: a cylindrical housing; a cylindrical insulator held inside the housing;

a center electrode held inside the insulator so that a tip end part protrudes; and a ground electrode that is connected to the housing and forms a spark discharge gap between the center electrode and the ground electrode, wherein the ground electrode includes an upright part that is vertically provided on a tip end part of the housing to a tip end side, and an inclined part that is bent from the tip of the upright part toward the center electrode side to extend toward an oblique tip end side, the inclined part has a ground end face that is an end face opposite to the upright part, an opposed face that faces the center electrode side, and a corner curved face having a curved shape that smoothly connects the ground end face and the opposed face, a curvature radius R of the corner curved face satisfies 0.3 mm≤R≤0.7 mm, and an inclination angle θ of the inclined part with respect to a plug axial direction satisfies 30°≤θ≤60°.

In the spark plug for the internal combustion engine, the ground electrode has the inclined part. Hence, degradation of ignitability of the air-fuel mixture can be suppressed by the mounting posture of the spark plug with respect to the internal combustion engine. That is, even if the upright part of the ground electrode is arranged at a position on an upstream side of an airflow with respect to a spark discharge gap, flow of the airflow along the inclined part, that is, flow of the airflow toward the tip end side can be generated near the spark discharge gap. This may easily stretch a discharge spark generated at the spark discharge gap toward the middle of the combustion chamber. Thus, the discharge spark stretched by the airflow can be prevented from approaching the engine head. Consequently, heat of the flame generated by ignition of the air-fuel mixture by the discharge spark is prevented from being absorbed by the engine head, and the flame can grow easily.

Furthermore, the inclined part has a corner curved face having a curved shape that smoothly connects the ground end face and the opposed face. The corner curved face has a smooth curved shape. Thus, concentration of an electric field on the corner curved face can be prevented. Thus, the ground electrode side starting point of the discharge spark generated at the spark discharge gap easily passes by the corner curved face and easily moves to the tip end side. This also easily stretches the discharge spark generated at the spark discharge gap toward the middle of the combustion chamber.

That is, in the spark plug for the internal combustion engine, the ground electrode not only has the inclined part, but also the inclined part has the corner curved face. Thus, the effect of stretching the discharge spark toward inside the combustion chamber can synergistically be obtained. Hence, ignitability of the air-fuel mixture can further be ensured.

The curvature radius R of the corner curved face satisfies 0.3 mm≤R≤0.7 mm, and the inclination angle θ of the inclined part satisfies 30°≤θ≤60°. This further provides an effect of improving the ignitability of the air-fuel mixture described above.

In the spark plug, the ground electrode dose not need a particularly complicated shape. The ground electrode does not need to be particularly thin, and thus, the ground electrode does not also need a special structure for ensuring its strength. Therefore, a spark plug excellent in ignitability having a simple structure can be obtained.

As described above, the present disclosure can provide a spark plug for an internal combustion engine having a simple configuration capable of ensuring stable ignitability, regardless of the mounting posture with respect to the internal combustion engine.

BRIEF DESCRIPTION OF THE DRAWINGS

The above object, the other objects, and features and advantages of the present disclosure will become clearer from the following detailed description with reference to the accompanying drawings. In the accompanying drawings.

DESCRIPTION OF THE EMBODIMENTS

First Embodiment

Referring to FIGS. 1 to 10, an embodiment of a spark plug for an internal combustion engine will be described.

Figure 1:
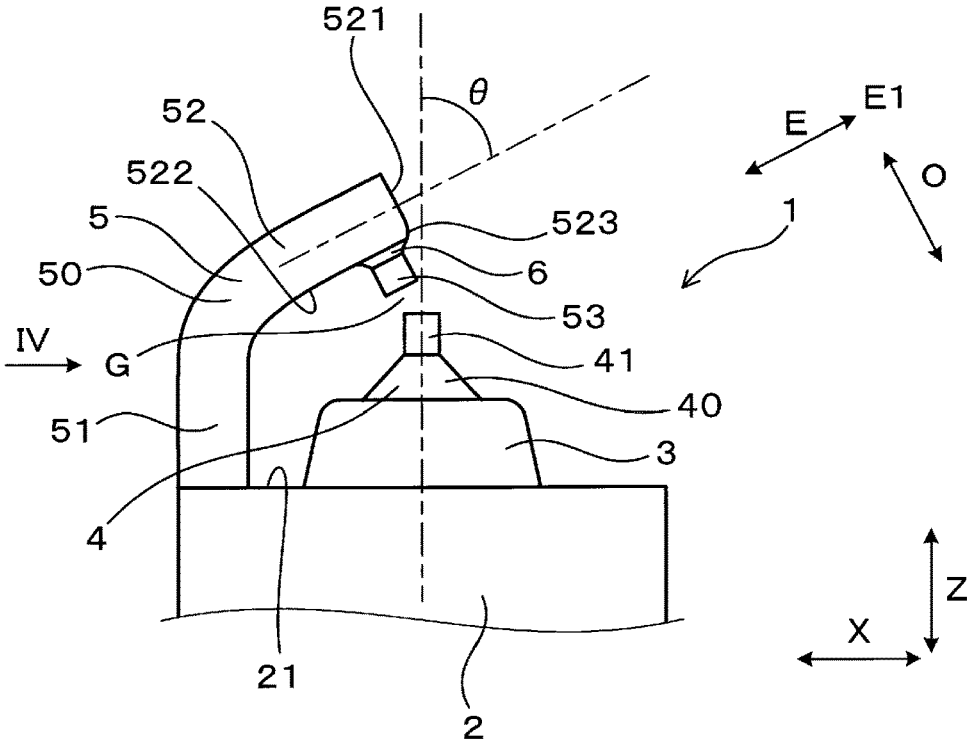
FIG. 1 is a front explanatory view of a tip end part of a spark plug according to a first embodiment.
Figure 4:
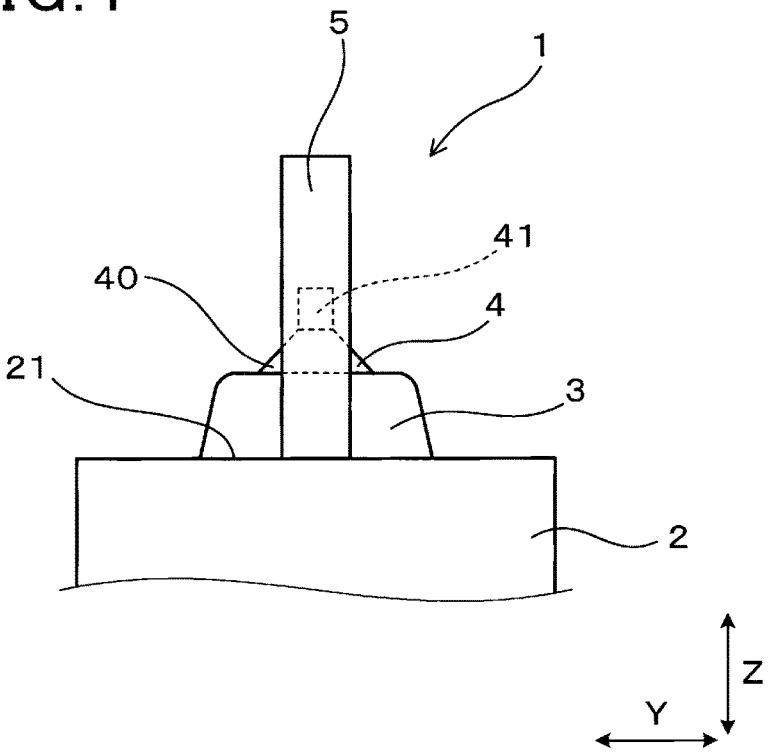
FIG. 4 is a view taken in the direction of an arrow IV of FIG. 1.

A spark plug 1 for an internal combustion engine of the present embodiment includes, as shown in FIGS. 1 and 4, a cylindrical housing 2, a cylindrical insulator 3, a center electrode 4, and a ground electrode 5. The insulator 3 is held inside the housing 2. The center electrode 4 is held inside the insulator 3 so that a tip end part 41 protrudes. As shown in FIG. 1, the ground electrode 5 is connected to the housing 2 and forms a spark discharge gap G between the ground electrode 5 and the center electrode 4. The ground electrode 5 includes an upright part 51 and an inclined part 52. The upright part 51 is vertically provided on a tip end part 21 of the housing 2 to a tip end side. The inclined part 52 is bent from a tip of the upright part 51 toward the center electrode 4 side, and is extended toward an oblique tip end side.

Figure 2:
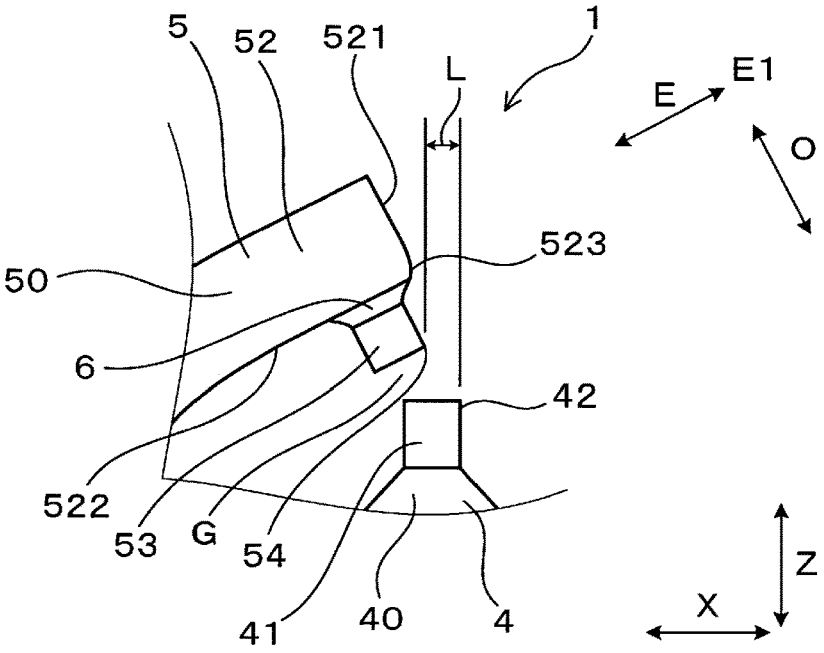
FIG. 2 is an enlarged front explanatory view obtained by enlarging a spark discharge gap and its periphery in FIG. 1.
Figure 3:
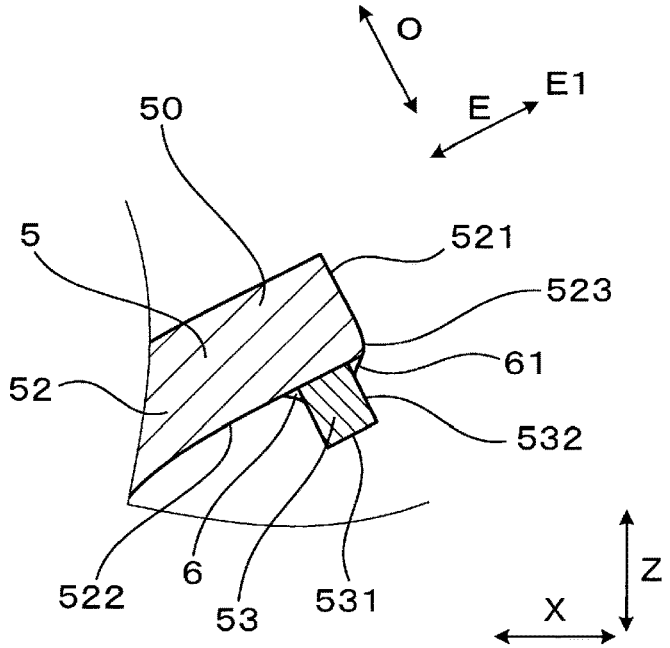
FIG. 3 is a cross-sectional view orthogonal to a width direction of a ground electrode at the middle position of the width direction according to the first embodiment.

As shown in FIGS. 1 to 3, the inclined part 52 has a ground end face 521, an opposed face 522, and a corner curved face 523. The ground end face 521 is an end face opposite to the upright part 51 in the inclined part 52. The opposed face 522 is a face facing the center electrode 4 side in the inclined part 52. The corner curved face 523 is a curved face that smoothly connects the ground end face 521 and the opposed face 522. A curvature radius R of the corner curved face 523 satisfies 0.3 mm≤R≤0.7 mm. An inclination angle θ of the inclined part 52 with respect to a plug axial direction Z satisfies 30°≤θ≤60°.

The spark plug 1 of the present embodiment is, for example, used in an internal combustion engine for a vehicle, such as an automobile.

The plug axial direction Z is the direction of the central axis of the spark plug 1. The tip end side refers to a side on which the spark plug 1 is inserted into a combustion chamber in the plug axial direction Z, and its opposite side refers to a base end side. An arrangement direction X of the upright part 51 and the center electrode 4 is simply referred to as an arrangement direction X. The direction orthogonal to each of the arrangement direction X and the plug axial direction Z is referred to as a width direction Y. The arrangement direction X, the width direction Y, and the plug axial direction Z are orthogonal to one another. In the following, an extension direction E of the inclined part 52 of the ground electrode 5 may simply be referred to as an extension direction E. The side opposite to the upright part 51 side of the inclined part 52 in the extension direction E may be referred to as an extension side E1. The direction orthogonal to each of the extension direction E and the width direction Y may be referred to as an orthogonal direction O.

As shown in FIG. 1, the upright part 51 of the ground electrode 5 is formed in parallel to the plug axial direction Z. The upright part 51 has a rectangular cross section orthogonal to the plug axial direction Z.

The ground electrode 5 is formed into a shape including the upright part 51 and the inclined part 52 by bending a rod-shaped metallic member having a rectangular cross section orthogonal to a longitudinal direction. Thus, the inclined part 52 also has a rectangular cross section orthogonal to the longitudinal direction of the inclined part 52, similar to that of the upright part 51 described above. The inclination angle θ of the inclined part 52 with respect to the plug axial direction Z is 30° to 60°. In the present embodiment, the inclination angle θ is nearly equal to that of the inclined part 52 with respect to the upright part 51.

As described above, the corner curved face 523 is formed between the ground end face 521 and the opposed face 522, of the ground electrode 5. As shown in FIG. 3, in the cross section orthogonal to the width direction Y, the corner curved face 523 has a curved shape that smoothly curves to the opposite side of the center electrode 4 in the orthogonal direction O toward the extension side E1 in the extension direction E. The curvature radius R of the curved shape satisfies 0.3 mm≤R≤0.7 mm.

As shown in FIGS. 1 to 3, the ground electrode 5 has a projection part 53 projecting from the opposed face 522 that faces the center electrode 4 side in the inclined part 52. As shown in FIGS. 1 and 2, the spark discharge gap G is formed between the projection part 53 and the tip end part 41 of the center electrode 4. The projection part 53 is formed by welding, for example, a precious metal chip made of a platinum alloy to the opposed face 522. That is, the ground electrode 5 has a ground electrode base material 50 made of a nickel alloy and the projection part 53 made of the precious metal chip. The precious metal chip is welded to the ground electrode base material 50. The welding of the projection part 53 to the opposed face 522 may be performed, for example, by laser welding.

In the present embodiment, the corner curved face 523 is formed over the entire inclined part 52 in the width direction Y. A formation range of the corner curved face 523 in the width direction Y is not limited to this, and may be a part of the inclined part 52 in the width direction Y. In this case, the corner curved face 523 is preferably formed at least in the same region as the projection part 53 in the width direction Y, that is, in a region 7 shown in FIG. 5.

As shown in FIG. 3, a surface 61 of a welded part 6 at which the projection part 53 is welded to the opposed face 522, has a curved shape that is smoothly curved, in a cross section including the central axis of the projection part 53. That is, the surface 61 of the welded part 6 has a smoothly curved shape that is curved to the outside in the radial direction of the projection part 53, toward the opposite side of the center electrode 4 in the orthogonal direction O at the cross section including the central axis of the projection part 53. In the present embodiment, a side face 532 of the projection part 53, the surface 61 of the welded part 6, the corner curved face 523, and the ground end face 521 are smoothly connected at a cross section orthogonal to the width direction Y at least at the middle position of the projection part 53 in the width direction Y.

Figure 5:
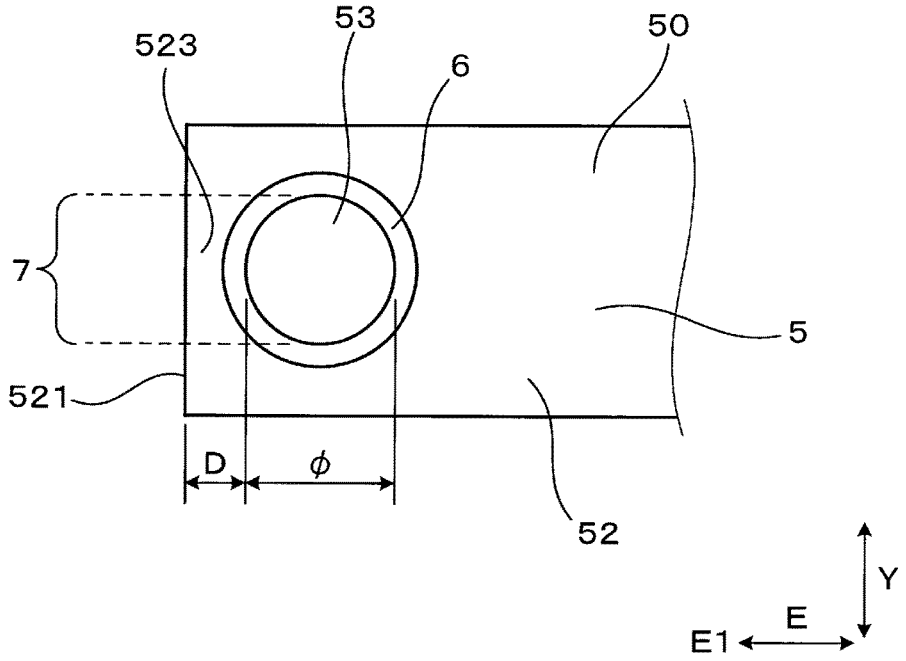
FIG. 5 is a view obtained by viewing the ground electrode from a projection side of a projection part according to the first embodiment.

As shown in FIG. 5, in the extension direction E, the minimum distance D between the projection part 53 and the ground end face 521 is shorter than the diameter 9 of the projection part 53. In the present embodiment, the minimum distance D is smaller than the radius ϕ/2 of the projection part 53. That is, the projection part 53 is arranged in a region close to the ground end face 521.

As shown in FIG. 1, the center electrode 4 is formed by joining, for example, the precious metal chip made of an iridium alloy to the tip of a center electrode base material 40. That is, the precious metal chip constitutes the tip end part 41 of the center electrode 4.

As shown in FIG. 2, a ground electrode edge 54 that is an edge on the side opposite to the upright part 51 of the ground electrode 5 in the arrangement direction X is positioned equivalent to a center electrode edge 42 that is an edge on the side opposite to the upright part 51 of the tip end part 41 of the center electrode 4, or closer to the upright part 51 than the center electrode edge 42. That is, in the arrangement direction X, when the upright part 51 side is plus and the side opposite to the upright part 51 is minus with reference to the center electrode edge 42, the distance L from the center electrode edge 42 to the ground electrode edge 54 satisfies L≥0. In the arrangement direction X, the ground electrode edge 54 is positioned closer to the upright part 51 than the center electrode edge 42. That is, in the present embodiment, the distance L further satisfies L>0. The ground electrode edge 54 is constituted by a part of the projection part 53 in the present embodiment. A part of the inclined part 52 may constitute the ground electrode edge 54 depending on the inclination angle θ of the inclined part 52, a projection amount of the projection part 53 and the like.

Effects of the present embodiment will then be described.

Figure 6:
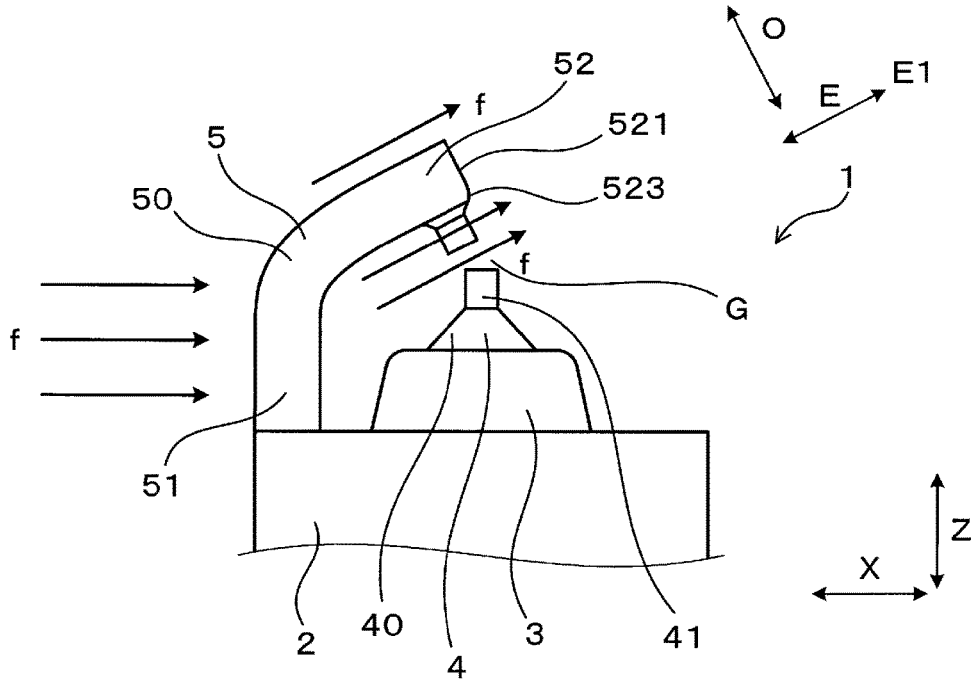
FIG. 6 is an explanatory diagram of an airflow along an inclined part according to the first embodiment.

In the spark plug 1 for the internal combustion engine, the ground electrode 5 has the inclined part 52. Hence, degradation of ignitability of the air-fuel mixture can be suppressed by the mounting posture of the spark plug 1 to the internal combustion engine. That is, even if the upright part 51 of the ground electrode 5 is arranged at a position on an upstream side of an airflow with respect to the spark discharge gap G, as shown in FIG. 6, flow of the airflow f along the inclined part 52, that is, flow of the airflow f toward the tip end side can be generated near the spark discharge gap G. Therefore, a discharge spark generated at the spark discharge gap G can easily be stretched toward a tip end side by the airflow f.

Referring to FIGS. 7 to 10, the description will be given on the moving of the starting point of a discharge spark S by being pushed by the airflow, if the upright part 51 is arranged at the upstream side position of the airflow with respect to the spark discharge gap G.

Figure 7:
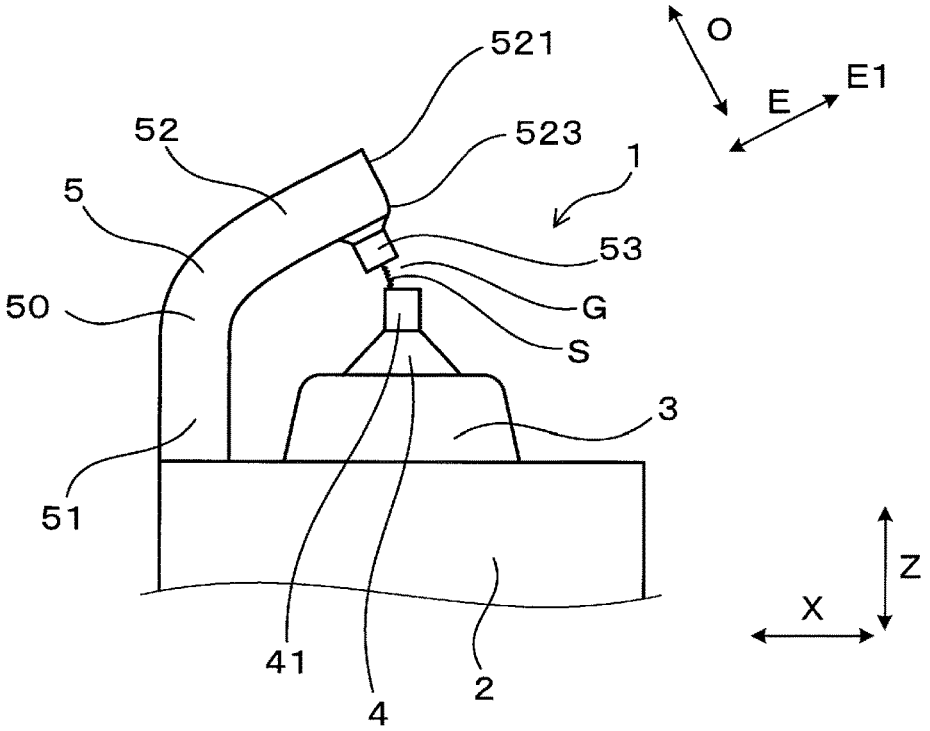
FIG. 7 is a front explanatory view showing an initial discharge spark according to the first embodiment.

As shown in FIG. 7, the spark discharge is generated at the spark discharge gap G by applying a predetermined voltage between the center electrode 4 and the ground electrode 5. An initial discharge spark S generated by the spark discharge may easily start from an upstream-side edge of the tip end face of the tip end part 41 of the center electrode 4. That is, because the distance between the center electrode 4 and the ground electrode 5 becomes minimum between the upstream-side edge in the tip end face of the tip end part 41 of the center electrode 4 and the projection part 53 of the ground electrode 5, the upstream-side edge in the tip end face of the tip end part 41 of the center electrode 4 is likely to become a starting point of the initial discharge spark S.

Figure 8:
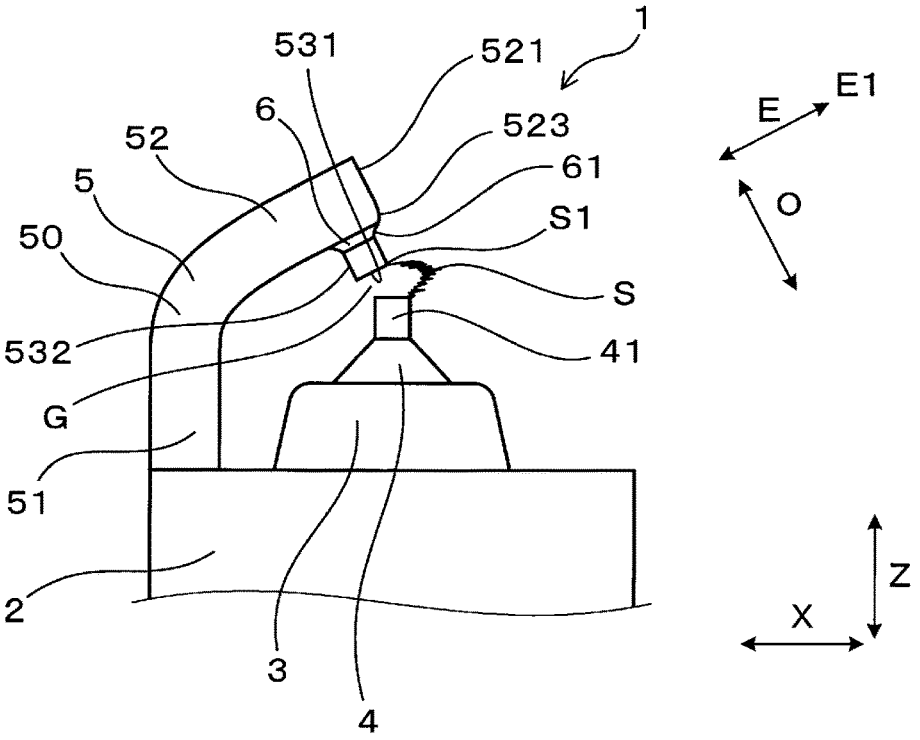
FIG. 8 is a front explanatory view showing a movement of both starting points of the discharge spark to a downstream side edge of a tip end face of a tip end part of a center electrode, and to a downstream side edge of a projection side end face of the ground electrode according to the first embodiment.

Then, as shown in FIG. 8, the initial discharge spark S generated at the spark discharge gap G is stretched to the downstream side, that is, to the extension side E1 in the extension direction E with time by the airflow near the spark discharge gap G. During the stretch, both starting points of the initial discharge spark S move with time. That is, the both starting points of the initial discharge spark S are pushed by the airflow and move to the downstream side edge in the tip end face of the tip end part 41 of the center electrode 4, and to the downstream side edge of the projection-side end face 531 of the projection part 53 of the ground electrode 5. In the following, the ground electrode 5 side starting point in the spark discharge gap G may be referred to as a ground electrode-side starting point 51.

Figure 9:
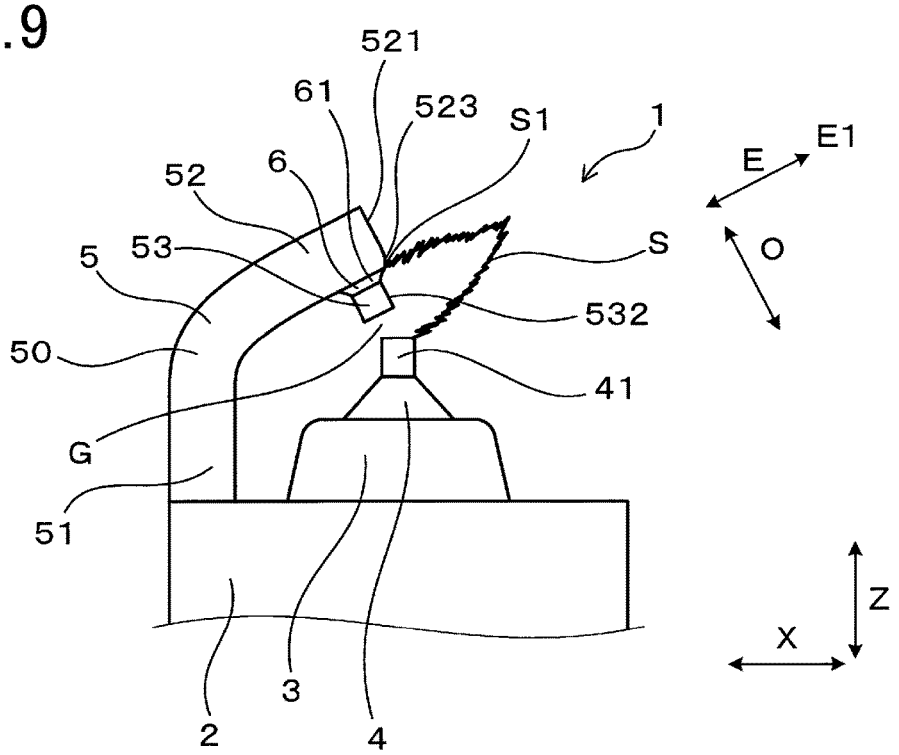
FIG. 9 is a front explanatory view showing a state in which a ground electrode-side starting point moves to a corner curved face and a portion between the starting points of the discharge spark is stretched to an oblique tip end side, according to the first embodiment.
Figure 10:
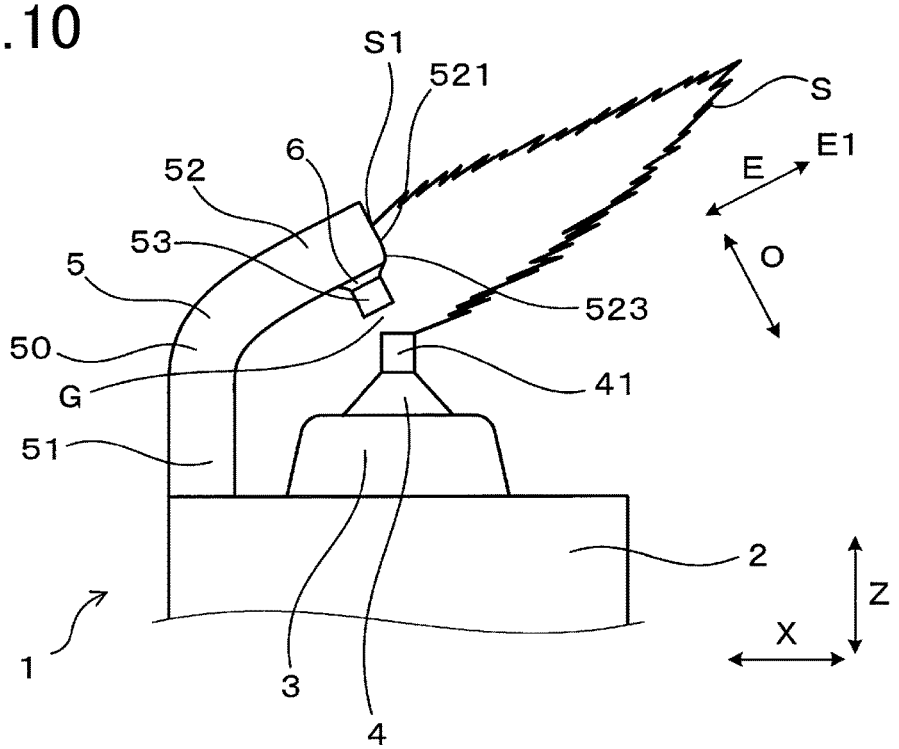
FIG. 10 is a front explanatory view showing a state in which a ground electrode-side starting point moves to a ground end face and a portion between the starting points of spark discharge is stretched to an oblique tip end side, according to the first embodiment.

Then, the discharge spark S is further pushed by the airflow. Thus, the ground electrode-side starting point 51 that has moved to the downstream-side edge of the projection-side end face 531 moves to the side face 532 of the projection part 53. Then, the ground electrode-side starting point 51 creeps and moves on the side face 532 to the opposite side of the center electrode 4 in the orthogonal direction O. Then, as shown in FIG. 9, the ground electrode-side starting point Si moves to the corner curved face 523 through the surface 61 of the welded part 6. Then, as shown in FIG. 10, the ground electrode-side starting point Si moves from the corner curved face 523 to the ground end face 521 and moves on the ground end face 521 toward the opposite side of the center electrode 4 in the orthogonal direction O.

As described above, of the both starting points of the discharge spark S, particularly the ground electrode-side starting point Si largely moves. Accordingly, the distance of the both starting points of the discharge spark S is increased. While the starting point of the discharge spark S moves as described above, a portion between the both starting points of the discharge spark S is largely stretched to the downstream side near the spark discharge gap G, that is, largely stretched to the extension side E1 in the extension direction E. Hence, the discharge spark to be stretched by the airflow can be kept away from the wall surface to the tip end side of the combustion chamber. As a result, the flame ignited by the discharge spark can be prevented from being cooled by the ground electrode 5 of the spark plug 1, the wall surface of the combustion chamber, or the like. That is, flame quenching action can be suppressed. Consequently, a flame can easily be grown in the combustion chamber to improve the ignitability.

The inclined part 52 further has the corner curved face 523 having a curved shape that smoothly connects the ground end face 521 and the opposed face 522. The corner curved face 523 has a smooth curved shape. Hence, concentration of an electric field on the corner curved face 523 can be prevented. Thus, the ground electrode 5 side starting point of the discharge spark generated at the spark discharge gap G easily passes by the corner curved face 523 and moves to the tip end side. Accordingly, the discharge spark generated at the spark discharge gap G is easily stretched toward the middle of the combustion chamber.

That is, in the spark plug 1 for the internal combustion engine, not only because the ground electrode 5 has the inclined part 52, but the inclined part 52 has the corner curved face 523, the effect of stretching the discharge spark toward inside the combustion chamber can synergistically be obtained. Hence, ignitability of the air-fuel mixture can further be ensured.

The curvature radius R of the corner curved face 523 satisfies 0.3 mm≤R≤0.7 mm, and the inclination angle θ of the inclined part 52 satisfies 30°≤θ≤60°. This further provides an effect of improving the ignitability of the air-fuel mixture described above. These numerical values are supported by the experimental examples to be described below.

In the spark plug 1, the ground electrode 5 does not need a particularly complicated shape. The ground electrode 5 does not need to be particularly thin, and thus, the ground electrode 5 does not also need a special structure for ensuring its strength. Hence, with the simple structure, the spark plug 1 excellent in ignitability can be obtained.

In the arrangement direction X, the ground electrode edge 54 that is the edge opposite to the upright part 51 of the ground electrode 5, is positioned equivalent to the center electrode edge 42 that is the edge opposite to the upright part 51 of the tip end part 41 of the center electrode 4, or is positioned closer to the upright part 51 than the center electrode edge 42. Thus, the ignitability of the air-fuel mixture can further be improved in the case where the upright part 51 is arranged at the upstream side position of the airflow with respect to the spark discharge gap G. That is, the flame generated by the ignition of the air-fuel mixture by the discharge spark stretched to the downstream side as described above can be prevented from approaching the ground electrode 5. Thus, cooling loss caused due to the heat of the flame absorbed by the ground electrode 5 can be suppressed.

In the extension direction E of the inclined part 52, the minimum distance D between the projection part 53 and the ground end face 521 is shorter than the diameter ϕ of the projection part 53. That is, in the extension direction E, the projection part 53 is arranged at the position close to the ground end face 521 in the opposed face 522. Hence, the length of the inclined part 52 can be as short as possible. Accordingly, the discharge spark is easily extended toward the tip end side, and thus, the ignitability can be improved even in the case where the upright part 51 is arranged at the upstream side position of the airflow with respect to the spark discharge gap G. When the projection part 53 is welded to the opposed face 522 of the ground electrode 5, the corner curved face 523 can be simultaneously formed at the corner between the ground end face 521 and the opposed face 522, by the heat of the welding. Hence, the easily manufactured spark plug 1 can be obtained.

As described above, according to the present embodiment, the spark plug for the internal combustion engine can be provided with a simple configuration of ensuring stable ignitability regardless of the mounting posture with respect to the internal combustion engine.

(Experimental example)

In the present example, as shown in Table 1, a relation between the inclination angle θ of the inclined part 52 of the ground electrode 5 and the curvature radius R of the corner curved face 523, and the ignitability was evaluated.

That is, with the spark plug 1 shown in the first embodiment as a basic structure, samples in which the inclination angle θ of the inclined part 52 and the curvature radius R of the corner curved face 523 were variously changed, were prepared and the ignitability of each of the samples was evaluated.

Specifically, as shown in Table 1, a plurality of samples were produced in which the inclination angles θ of the inclined part 52 were variously changed between 10° and 90°, and the curvature radius R of the corner curved face 523 was variously changed between 0 mm and 0.9 mm. The sample with the inclination angle θ of the inclined part 52 set to 90° was a spark plug having the inclined part orthogonal to the upright part. The sample with the curvature radius R set to 0 mm was a spark plug with the corner formed between the ground end face and the opposed face.

Of the plurality of samples, a sample in which the inclination angle θ of the inclined part 52 was 90° and the curvature radius R of the corner curved face 523 was 0 mm, was used as a reference sample, and the ignitability of each of the samples was evaluated in comparison with the ignitability of the reference sample.

The ignitability was evaluated with a lean limit A/F as an index. That is, in the internal combustion engine mounting each of the samples, an air-fuel ratio (that is, NF) of the air-fuel mixture was gradually changed, and an air-fuel ratio as the ignitable limit (that is, lean limit A/F) was measured.

The conditions of the internal combustion engine in the present test were set to a displacement of 1800 cc, an engine speed of 2000 rpm, and an indicated mean effective pressure of 0.28 MPa. An air-fuel ratio where a combustion fluctuation ratio (that is, the fluctuation ratio of the indicated mean effective pressure) was 3% was set to the lean limit A/F. The lean limit A/F was an average of values obtained by performing the test five times for each of the samples.

The other conditions of each of the samples are as follows, and are in common in each of the samples.

A dimension w of the upright part 51 of the ground electrode 5 in the width direction Y was set to 2.6 mm, a dimension t in the arrangement direction X was set to 1.3 mm. A dimension of the spark discharge gap G was set to 0.8 mm. The precious metal chip constituting the projection part 53 of the ground electrode 5 was formed into a circular cylindrical shape with a diameter of 1.0 mm and a length of 0.8 mm. The precious metal chip constituting the tip end part 41 of the center electrode 4 was formed into a circular cylindrical shape with a diameter of 0.7 mm and a length of 0.6 mm. The thread diameter of the mounting screw part of the housing 2 was M12. The projection dimension of the center electrode 4 from the tip end face of the housing 2 in the plug axial direction Z was set to 3 mm.

The posture of the spark plug 1 mounted to the internal combustion engine was a posture such that the upright part 51 of the ground electrode 5 is positioned on the upstream side of the airflow with respect to the center electrode 4.

The evaluation result is shown in Table 1. In Table 1, D refers to the lean limit A/F which is equivalent to that of the reference sample (that is, the difference between the lean limit A/F of the reference sample and the results is less than 0.05). C refers to the lean limit A/F which is improved by 0.05 or more and less than 0.1 with respect to the reference sample. B refers to the lean limit A/F which is improved by 0.1 or more and less than 0.4 with respect to the reference sample. A refers to the lean limit A/F which is improved by 0.4 or more with respect to the reference sample.

TABLE 1

| inclination | R(mm) | | | | | |
|---|---|---|---|---|---|---|
| angle θ(°) | 0 | 0.1 | 0.3 | 0.5 | 0.7 | 0.9 |
| 90 | reference value | D | C | C | C | D |
| 80 | D | D | C | B | C | C |
| 60 | C | C | B | A | B | C |
| 45 | C | B | A | A | A | B |
| 30 | C | C | B | A | B | C |
| 10 | D | D | D | D | D | D |

Table 1 shows that the samples, in which the inclination angles θ of the inclined part 52 were set to 30° to 60° and the curvature radius R of the corner curved face 523 were set to 0.3 mm to 0.7 mm, were evaluated as A or B. Thus, the ignitability was particularly improved. That is, as the inclination angle θ satisfies 30°≤θ≤60° and the curvature radius R satisfies 0.3 mm s R s 0.7 mm, the synergistic effect was obtained.

Second Embodiment

Figure 11:
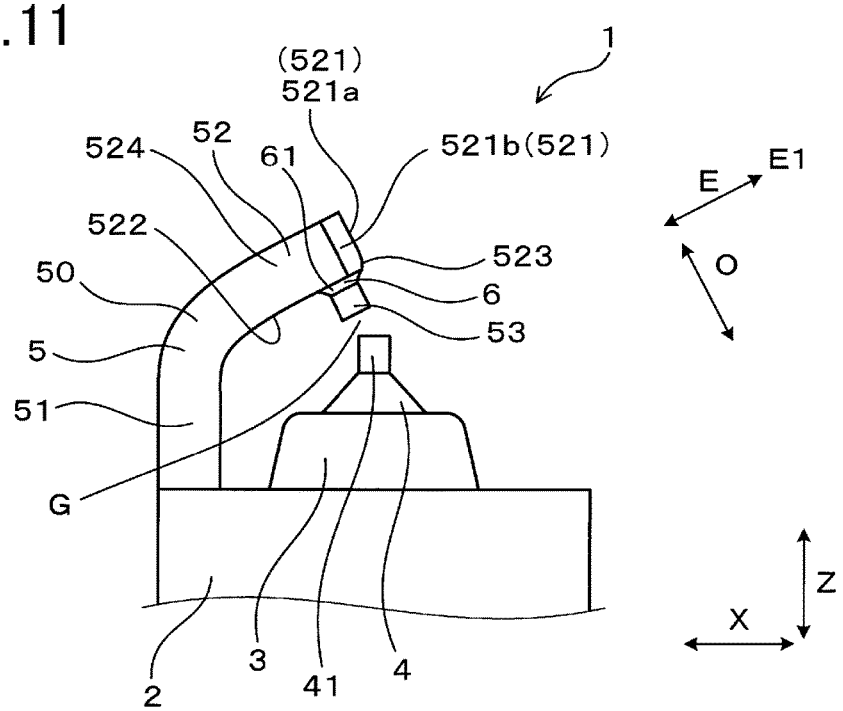
FIG. 11 is a front explanatory view of a tip end part of a spark plug according to a second embodiment.
Figure 12:
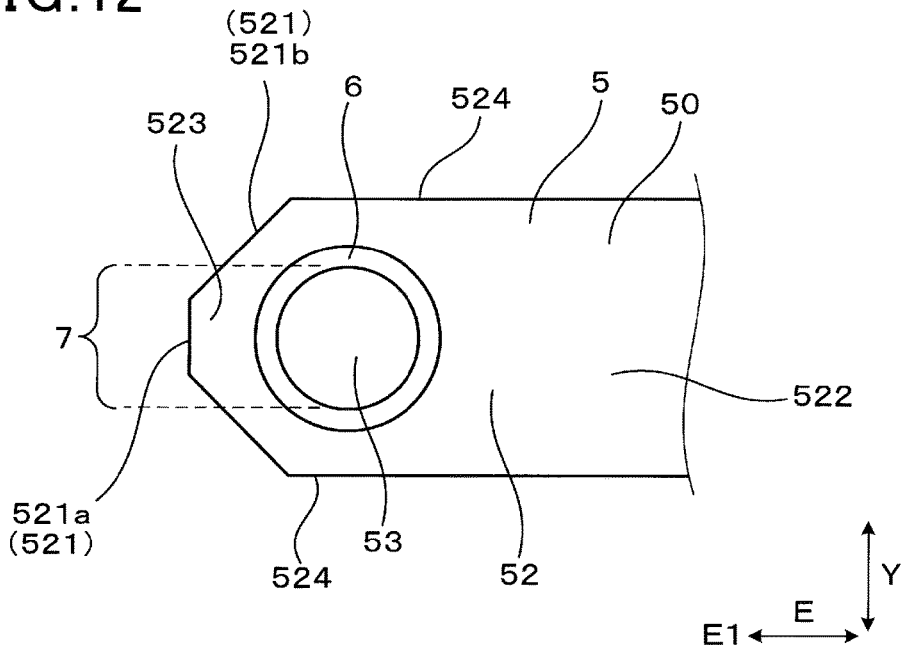
FIG. 12 is a view obtained by viewing a ground electrode from a projection side of a projection part according to the second embodiment.

As shown in FIGS. 11 and 12, the present embodiment changes the shape of the end portion of the extension side E1 in the extension direction E of the inclined part 52, contrary to the first embodiment.

As shown in FIG. 12, the shape of the end portion of the inclined part 52 on the extension side E1 in the extension direction E has a thinner shape in the width direction Y toward the extension side E1.

That is, when viewed in the orthogonal direction O, the end portion of the inclined part 52 on the extension side E1 has a smaller dimension in the width direction Y toward the extension side E1 in the extension direction E.

In the present embodiment, the ground end face 521 has a parallel face 521*a* with the normal direction as the extension direction E, and a pair of taper faces 521*b* with the normal direction inclined to the width direction Y with respect to the extension direction E. The pair of taper faces 521*b* is formed on both sides of the parallel face 521*a* in the width direction Y. The pair of taper faces 521*b* is formed so as to connect one pair of side faces 524 of the inclined part 52 and the parallel face 521*a*. The pair of taper faces 521*b* is inclined so as to approach the width direction Y, toward the parallel face 521*a* from the pair of side faces 524, in the extension direction E.

The corner curved face 523 is formed so as to smoothly connect the parallel face 521*a* and the pair of taper faces 521*b*, and the opposed face 522. In the present embodiment, the corner curved face 523 is also formed all over the inclined part 52 in the width direction Y. In the present embodiment, the formation region of the corner curved face 523 is also not limited to this, and may be a part of the inclined part 52 in the width direction Y. In this case, similar to the first embodiment, the corner curved face 523 is preferably formed at least in the same region as the projection part 53 in the width direction Y, that is, in the region 7 shown in FIG. 12.

Other configurations are the same as those of the first embodiment.

Of the reference signs used in the second embodiment and the subsequent embodiments, the same reference signs as those used in the embodiments described indicate the same components and the like as those in the embodiments, unless otherwise indicated. The present embodiment also has the same effects as those of the first embodiment.

The present disclosure has been described according to the embodiments. However, the present disclosure should not be construed as being limited to the embodiments and structures. The present disclosure includes various modified examples and modifications within the range of equivalents. In addition, various combinations and forms, as well as other combinations and forms further including only one element, more elements, or less elements, are included within the scope and the spirit of the present disclosure. For example, in the above embodiments, the configuration of providing the projection part 53 to the ground electrode 5 is described, but another configuration may not provide the projection part to the ground electrode. In this case, the corner curved face is preferably formed over the entire width direction of the ground electrode.

The invention claimed is:

1. A spark plug for an internal combustion engine, comprising:

a cylindrical housing;

a cylindrical insulator held inside the housing;

a center electrode held inside the insulator so that a tip end part protrudes; and a ground electrode that is connected to the housing and forms a spark discharge gap between the center electrode and the ground electrode, wherein:

the ground electrode includes an upright part that is vertically provided on a tip end part of the housing to a tip end side and an inclined part that is bent from the tip of the upright part toward the center electrode side to extend toward an oblique tip end side, the inclined part has a ground end face that is an end face opposite to the upright part, an opposed face that faces the center electrode side, and a corner curved face that has a curved face shape smoothly connecting the ground end face and the opposed face, a curvature radius R of the corner curved face satisfies 0.3 mm≤R≤0.7 mm, and an inclination angle θ of the inclined part with respect to a plug axial direction satisfies 30°≤θ≤60°.

2. The spark plug for an internal combustion engine according to claim 1, wherein:

an edge of the ground electrode, which is opposite to the upright part, is positioned equivalently to an edge of the tip end part of the center electrode, which is opposite to the upright part, or closer to the upright part than to the edge in an arrangement direction of the upright part and the center electrode.

3. The spark plug for an internal combustion engine according to claim 1, wherein:

the ground electrode has a projection part projecting from the opposed face of the inclined part, and the spark discharge gap is formed between the projection part and the tip end part of the center electrode.

4. The spark plug for an internal combustion engine according to claim 3, wherein:

a minimum distance between the projection part and the ground end face is shorter than a diameter ϕ of the projection part in an extension direction of the inclined part.

* * * * *